US006475014B2

(12) United States Patent
Tsuji et al.

(10) Patent No.: US 6,475,014 B2
(45) **Date of Patent: *Nov. 5, 2002**

(54) CONNECTOR FITTING STRUCTURE

(75) Inventors: Masanori Tsuji, Shizuoka (JP); Matohisa Kashiyama, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/556,822

(22) Filed: Apr. 21, 2000

(65) Prior Publication Data

US 2001/0046814 A1 Nov. 29, 2001

(30) Foreign Application Priority Data

Apr. 28, 1999 (JP) ..... 11-122610
May 7, 1999 (JP) ..... 11-127398

(51) Int. Cl.[7] ..... H01R 13/627
(52) U.S. Cl. ..... 439/352
(58) Field of Search ..... 439/352, 159, 439/923, 489, 188

(56) References Cited

U.S. PATENT DOCUMENTS 4,708,413 A 11/1987 Schroeder ..... 439/358
5,030,127 A 7/1991 Blasko et al. ..... 439/353
5,425,650 A 6/1995 Maeda ..... 439/374
6,095,843 A * 8/2000 Kaneko et al. ..... 439/352

FOREIGN PATENT DOCUMENTS

EP 0 896 396 2/1999 ..... H01R/13/627

* cited by examiner

*Primary Examiner*—Tho D. Ta
*Assistant Examiner*—Phuong Chi Nguyen
(74) *Attorney, Agent, or Firm*—Sughrue Mion, PLLC

(57) ABSTRACT

In the connector fitting structure 1 of the invention, a male connector 10 includes lock arms 16, each having a housing lock 18 formed at a distal end thereof, first engagement portions 46 formed on an inner surface of an outer housing 11, and a second engagement portion 48 formed on the outer housing 11 and disposed below the lock arms 16. The housing locks 18 are engageable with engagement projections 43, respectively, and a pressing portion 19 is formed on an upper surface of the lock arms 16. First and second slide members 21 and 26, holding compression springs 33 therebetween, are mounted within the outer housing 11 so as to slide in a fitting direction. The second slide member 26 includes first engagement arms 28 for engagement respectively with the first engagement portions 46, a second engagement arm 47 for engagement with the second engagement portion 48, and retaining portions 27 for respectively locking the lock arms 16 after the fitting operation is effected. The first slide member 21 has a slide groove 22 for allowing the first engagement arms 28 to escape thereinto.

16 Claims, 14 Drawing Sheets

1

1

CONNECTOR FITTING STRUCTURE

BACKGROUND OF THE INVENTION

1. Technical Field to which the Invention Belongs

This invention relates to a connector fitting structure in which a half-fitted condition is positively prevented by a resilient force of a resilient member provided in at least one of a pair of female and male connectors to be mutually fitted together. The connector can be positively locked to the mating connector in a fitted condition, and a cancellation operation can be easily effected.

2. Related Art

Usually, many pieces of electronic equipment are mounted on a vehicle, such as an automobile. Various cables for supplying power to these equipments and for controlling these equipments, as well as female and male connectors for connecting these cables, are extensively used. Such female and male connectors have a waterproof function in view of a possibility that these connectors will be used in a severe environment involving vibrations and submergence. Also, in view of an assembling process and their maintenance, these connectors also have a function by which the connection and disconnection of the cables can be effected easily. There have been proposed various connector fitting structures capable of detecting a mutually-fitted condition of female and male connectors.

One example of such general connector fitting structures will be described with reference to FIGS. 9 to 12.

As shown in FIG. 10, a male connector (one connector) 60 of the general connector fitting structure 51 includes an inner housing 62 which has terminal receiving chambers and is open to the front side thereof (arrow A shows front side and fitting direction); and an outer housing 61 which has a slider 70 (described later) slidably mounted therein above the inner housing, and forms a hood portion covering the outer periphery of the inner housing 62.

As shown in FIG. 10, a male connector (one connector) 60 of the general connector fitting structure 51 includes an inner housing 62 which has terminal receiving chambers and is open to the front side thereof; and an outer housing 61 which has a slider 70 (described later) slidably mounted therein above the inner housing, and forms a hood portion covering the outer periphery of the inner housing 62.

A pair of housing locks 68 for respectively retaining engagement projections 93 (see FIG. 10) of a mating housing 91 (described later) are formed respectively on upper surfaces of the distal ends of the lock arms 66. A pressing portion 69, which is operated when canceling the fitting connection, is provided on the upper surface of the lock arms 66 at a generally central portion thereof.

A pair of retaining arms 67 for temporarily preventing the rearward movement of the slider 70 are provided at a rear portion of the slider receiving portion 63, and extend rearwardly in the fitting direction, and each of the retaining arms 67 has a retaining projection 67*a* formed at a rear end (free end) thereof.

The slider 70 includes: a first slide member 71, which is guided by the guide grooves 65 so as to slide within the slider receiving portion 63; a second slide member 76 engaged with a rear portion of the first slide member 71; and compression springs (resilient members) 83 held on the second slide member 76.

The first slide member 71 includes: a pair of stopper arm portions 73 and 73, which extend rearwardly, are abutted respectively against one ends of the compression springs 83; and an interconnecting portion 74 interconnecting the stopper arm portions 73. An abutment portion 75, against which a pressing rib 92 of a female connector 90 (described later) can abut, is formed at a lower surface of the interconnecting portion 74. A pair of slide grooves 72 and 72 for allowing the movement of engagement arm portions 78 (described later) of the second slide member 76 are formed in opposite ends of the interconnecting portion 74.

The second slide member 76 includes retaining portions 77 which extend forwardly. Outer side portions of retaining portion 77 are slidably fitted in the guide grooves 65, respectively. The distal ends of the retaining portion 77 respectively retain the housing locks 68 which are formed respectively at the distal ends of the lock arms 66, when the lock arms are displaced. An elastic operating portion 79 which is operated when canceling the fitting connection is formed on a central portion of the upper side of the second slide member 76. When the slider 70 is inserted into the slider receiving portion 63, the operating portion 79 covers the pressing portion 69 of the lock arms 66 from above. distal ends of the retaining portion 77 respectively retain the housing locks 68 which are formed respectively at the distal ends of the lock arms 66, when the lock arms are displaced. An elastic operating portion 79 which is operated when canceling the fitting connection is formed on a central portion of the upper side of the second slide member 76. When the slider 70 is inserted into the slider receiving portion 63, the operating portion 79 covers the pressing portion 69 of the lock arms 66 from upward.

The pair of engagement arm portions 78 and 78, retained respectively by the stopper arm portions 73 of the first slide member 71, are formed respectively at opposite side walls of the second slide member 76. Spring receiving chambers 81 for respectively receiving the compression springs 83 are formed respectively in the opposite side portions of the second slide member 76.

The female connector (the other connector) 90 includes a housing insertion port 94 open to the front side thereof (opposite to arrow A). The pressing rib 92 for abutting against the abutment portion 75 of the first slide member 71 is formed upright on an upper surface of the housing 91 at a central portion thereof. The pair of engagement projections 93 and 93 are formed respectively at opposite side portions of the pressing rib 92, and these engagement projections 93 and 93 elastically deform the lock arms 66, respectively, and engage the housing locks 68, respectively.

Next, the operation for fitting the male and female connectors 60 and 90 of the above connector fitting structure 51 together will be described.

First, the slider 70 is assembled as shown in FIG. 10. More specifically, for assembling the slider 70, the pair of compression springs 83 are inserted respectively into the spring receiving chambers 81 in the second slide member 76, and then the first slide member 71 and the second slide member 76 are combined together, with the stopper arm portions 73 of the first slide member 71 held respectively in the spring receiving chambers 81.

Then, for mounting the slider 70 on the male connector 60, the slider 70 is inserted into the slider receiving portion 63 from the front side of the male connector 60. At this time, the opposite side portions of the stopper arm portions 73 of the first slide member 71, the opposite end portions of the interconnecting portion 74 and the opposite side portions of the second slide member 76 are fitted in the guide grooves 65. And the rear end of the second slide member 76 is brought into engagement with the retaining arms 67, thus completing the mounting of the slider 70.

Next, the operation for fitting the male and female connectors 60 and 90 of the above general connector fitting structure 51 together will be described with reference to FIGS. 10 to 12.

The inner housing 62 of the male connector 60 and the housing insertion port 94 in the female connector 90 are opposed to each other, and in this condition the male and female connectors begin to be fitted together in such a manner that the outer housing 61 of the male connector 60 is fitted on the housing 91 of the female connector 90, as shown in FIG. 11. At this time, the pressing rib 92 of the female connector 90 is fitted into an insertion notch 77*a* (see FIG. 10) of the second slide member 76, and the front end of the pressing rib 92 is brought into abutting engagement with the abutment portion 75 of the first slide member 71.

Then, while pushing the first slide member 71, the pressing rib 92 of the female connector 90 is inserted into an insertion space 66*a* (see FIG. 10) between the lock arms 66 of the male connector 60, as shown in FIG. 12. At this time, the engagement projections 93 at the front end of the pressing rib 92 are brought into sliding contact respectively with slanting surfaces of the housing locks 68 which is formed respectively at the distal ends of the lock arms 66, to displace the distal end portions of the lock arms 66 toward the housing 91 of the female connector 90 (that is, downwardly in the drawings). Therefore, the distal ends of the housing locks 68 are engaged respectively with the retaining portions 77 of the second slide member 76, so that the second slide member 76 can not slide together with the first slide member 71.

Then, when the fitting operation further proceeds, the first slide member 71 is pressed by the pressing rib 92, and therefore is moved rearwardly. At this time, the engagement arm portions 78 (see FIG. 10) of the second slide member 76 are moved respectively into the slide grooves 72 (see FIG. 10) formed respectively in the opposite side portions of the first slide member 71. Thus, the first slide member 71 is moved while the second slide member 76 is held against movement, and as a result the compression springs 83, received in the second slide member 76, are compressed to produce restoring forces tending to resiliently restore them into their original condition.

If the fitting operation is stopped in a half-fitted condition in which the housing locks 68 of the male connector 60 are not completely engaged with the engagement projections 93 of the female connector 90, respectively, the first slide member 71 is pushed back in a disengaging direction (opposite to the fitting direction) by the restoring force of the compression springs 83. As a result, the female connector 90 is pushed back through the pressing rib 92, abutted against the abutment portion 75 of the first slide member 71, and therefore the half-fitted condition can be prevented.

Then, when the fitting operation is further continued against the repulsive force of the compression springs 83, the engagement projections 93 of the female connector 90 slide respectively over the housing locks 68, formed respectively at the distal ends of the lock arms 66, so that the lock arms 66 are resiliently restored, as shown in FIG. 13. As a result, the engagement of the distal end of each housing lock 68 with the associated retaining portion 77 at the distal end of the second slide member 76 is canceled, so that the housing lock 68 is engaged with the rear end of the associated engagement projection 93. Therefore, the male connector 60 and the female connector 90 are completely fitted together, so that contacts 64 in the male connector are completely electrically contacted respectively with contacts 95 in the female connector.

For canceling the above completely-fitted condition, while holding the operating portion 79 of the second slide member 76 with the finger or other, the second slide member 76 is moved forward against the restoring force of the compression springs 83 into such a position that the operating portion 79 overlies the exposed pressing portion 69 of the lock arms 66, as shown in FIG. 14. Then, when the operating portion 79 is pressed down, the pressing portion 69 is pressed downward, so that the lock arms 66 are displaced downward, and therefore the engagement of the housing locks 68 with the respective engagement projections 93 is canceled. At this time, the slide member 71 is pushed back forward by the restoring force of the compressed compression springs 83.

As a result, the female connector 90 is pushed back in the disengaging direction through the pressing rib 92 of the female connector 90 abutted against the abutment portion 75 of the first slide member 71. Therefore, the disengaging force, required for disengaging the connectors from each other, can be reduced, and the disengaging operation can be enhanced.

In the above general connector fitting structure 51, however, when the mounting of the slider 70 is completed, the compression springs 83 produce slight restoring forces. Therefore, when the male connector 60, having the slider mounted thereon, is transported, the engagement arm portions 78 can be disengaged from the engagement surfaces of the stopper arm portions 73 because of vibrations and so on developing during the transport, and also the rear end surface of the second slide member 76 can be disengaged from the retaining projections 67*a* of the retaining arms 67.

Therefore, before the fitting operation is effected, the first slide member 71 is withdrawn and dropped, and also the second slide member 76 is moved toward the rear end of the outer housing 61, so that the retaining portions 77 underlie the housing locks 68, respectively, which invites a problem that the lock arms 66 can not be flexed during the fitting operation.

In the above general connector fitting structure 51, however, for canceling the fitted condition, while holding the operating portion 79 of the second slide member 76 with the finger or other, the second slide member 76 must be moved forward against the restoring force of the compression springs 83 into such a position that the operating portion 79 overlies the exposed pressing portion 69 of the lock arms 66, and then the operating portion 79 must be pressed down, as described above. Therefore, there has been encountered a problem that the operability is poor.

And besides, the operating portion 79 is pressed down while pushing the second slide member 76 with a large force against the restoring force of the compression springs 83, and therefore there is a possibility that the unduly-large pressing force is applied to this operating portion. In such a case, the lock arms are excessively displaced, which in some times, invites a problem that the lock arms 66 are damaged.

With the above problems in view, it is an object of this invention to provide a connector fitting structure in which a half-fitted condition can be positively detected during a fitting operation of a pair of female and male connectors, and also ensures easy operation the fitting procedure.

The problems to be overcome by the present invention can be solved by the following constructions (1) to (3):

(1) A connector fitting structure including:

A pair of female and male connectors connected together;

one of said connector including an inner housing and an outer housing, said outer housing covering said inner housing, a lock arm provided on the front end of said inner housing;

a slide member movably mounted on said outer housing, said slide member including first and second slide member, and a resilient member, said first slide member slidable with respect to said outer housing in fitting direction, said second slide member engaged with a rear end of said first slide member, said resilient member positioned between said first and second slide members to urge said first and second slide members away from each other;

the other of said connector provided with a pressing rib which abuts against said slide member, and an engagement projection, which flexes said lock arm and engages with said lock arm, provided on said pressing rib;

a first elastically engagement arm provided at said second slide member, engageable with a first engagement portion which is provided at an inner surface of said outer housing;

a second elastically engagement arm provided at said second slide member, engageable with a second engagement portion which is provided at an upper surface of said inner housing;

a slide groove provided at said first slide member; and wherein said slide groove cancels the engaged condition of said first engagement arm and said first engagement portion, and a distal end of the other connector housing cancels the engaged condition of said second engagement arm and said second engagement portion at a time of said first slide member moving toward said second slide member.

(2) A retaining portion, for preventing a downward displacement of said lock arm, is provided at the front end of said second slide member.

(3) an auxiliary retaining surface provided at said first slide member;

an auxiliary retaining arm shaped flat plate and provided at said second slide arm; and wherein said auxiliary retaining arm is retained by an auxiliary retaining surface.

In the connector fitting structure of the above construction, the second slide member includes the first engagement arms of an elastic nature, which can be engaged respectively with the first engagement portions formed on the inner surface of the outer housing of the one connector. Therefore, the housing of the other connector is fitted in the one connector, and the engagement projections of the other connector depress the housing locks, respectively, and thereafter unless the distal end portions of the first engagement arms are caused to escape into the slide groove, the first engagement arms will not be disengaged from the first engagement portions, respectively.

Therefore, before the housing locks are pressed down, the second slide member will not be accidentally moved rearward by vibrations and so on, and therefore there will not be encountered a situation in which the fitting operation of the female and male connectors can not be effected, and therefore the reliability of the female and male connectors can be enhanced.

The second slide member also includes the second engagement arm of an elastic nature which can be engaged with the second engagement portion formed on the outer housing of the one connector. Therefore, until the second engagement arm is disengaged from the second engagement portion by the front end of the housing of the other connector, that is, until the time immediately before the housing locks are engaged respectively with the engagement projections of the other connector, the engaged condition of the second slide member will not be canceled.

Therefore, the resilient force of the resilient member is kept strong until the time immediately before the completely-fitted condition is achieved, and therefore if the fitting force is weakened in a half-fitted condition, the other connector can be positively disengaged from the one connector with a large force, and therefore the reliability of the male and female connectors can be further enhanced.

The second slide member has the retaining portions which are formed at the front end thereof, and can prevent the downward displacement of the housing locks, and the slanting surface, which is slanting downwardly rearwardly, is formed on the rear end surface of each of the retaining portions. Therefore, each housing lock smoothly slides upwardly on the rear end surface of the retaining portion with the large resilient force of the resilient member, and is brought into engagement with the engagement projection of the other connector.

Therefore, the completely-fitted condition can be positively achieved with the relatively small fitting force, and therefore the reliability of the female and male connectors can be further enhanced.

The second slide member includes the flat plate-like auxiliary retaining arms which can be retained respectively by the auxiliary retaining surfaces of the first slide member. Therefore, the second slide member can be engaged with the first slide member in a stable manner, and will not be disengaged from the first slide member by vibrations and so on, and the reliability of the slider can be enhanced.

With the above problems in view, it is an object of this invention to provide a connector fitting structure in which a half-fitted condition can be positively detected during a fitting operation of a pair of female and male connectors, and besides a fitting connection-canceling operation is easy.

The problems to be overcome by the present invention can be solved by a connector fitting structure described in the following Paragraphs (4) and (5):

(4) A connector fitting structure comprising:

a pair of female and male connectors connected together;

one of said connector including an inner housing and an outer housing, said outer housing covering said inner housing, a lock arm provided on the front end of said inner housing;

a slide member movably mounted on said outer housing, said slide member including first and second slide members, and a resilient member, said first slide member slidable with respect to said outer housing in fitting direction, said second slide member engaged with the rear end of said first slide member, said resilient member positioned between said first and second slide members to urge said first and second slide members away from each other; member engaged with the rear end of said first slide member, said resilient member positioned between said first and second slide members to urge said first and second slide members away from each other;

the other of said connector provided with a pressing rib which abuts against said slide member, and an engagement projection, which flexes said lock arm and engages with said lock arm, provided on said pressing rib; and a disengagement prevention portion provided at upper portion of said second slide member, for canceling an engagement with said lock arm and said engagement projection;

wherein said engagement is canceled by which said lock arm is deformed downwardly by abutting against said disengagement prevention portion.

(5) In the connector fitting structure, preferably, an engagement arm provided at said second slide member, and engageable with an engagement portion which is provided at the inner surface of said outer housing; and a slide groove provided at said first slide member;

wherein said engagement arm is accommodated in said slide groove by moving said second slide member forward at the time of canceling said engagement.

In the connector fitting structure of the above construction, the second slide member includes the first engagement arms of an elastic nature, which can be engaged respectively with the first engagement portions formed on the inner surface of the outer housing of the one connector. Therefore, the housing of the other connector is fitted in the one connector, and the engagement projections of the other connector depress the housing locks, respectively, and thereafter unless the distal end portions of the first engagement arms are caused to escape into the slide groove, the first engagement arms will not be disengaged from the first engagement portions, respectively.

The cancellation projection is formed on the lower surface of the front end of the disengagement prevention portion (of the second slide member) which is operated when canceling the fitting connection. Therefore, when canceling the fitted condition of the female and male connectors, it is only necessary to push the second slide member forward directly or through the disengagement prevention portion, and therefore the operation, required for canceling the fitted condition, is easy, and the efficiency of the operation can be enhanced.

And besides, the amount of flexing of the lock arms is determined by the vertical dimensions of the cancellation projection and pressing portion, and therefore the lock arms will not be excessively displaced, and hence will not be damaged, and the durability of the female and male connector can be enhanced.

The second slide member has the first engagement arms engageable respectively with the first engagement portions formed on the inner surface of the outer housing, and when the second slide member is moved forward for canceling the fitting connection, the first engagement arms are caused to escape into the slide groove formed in the first slide member. Therefore, the engagement of the housing locks of the lock arms with the respective engagement projections of the other connector can be canceled with a relatively-small pushing force. Therefore, the efficiency of the operation, required for canceling the fitted condition of the female and male connectors, can be further enhanced.

DETAILED DESCRIPTION OF THE PREFERRED EMBODIMENTS

Figure 1:
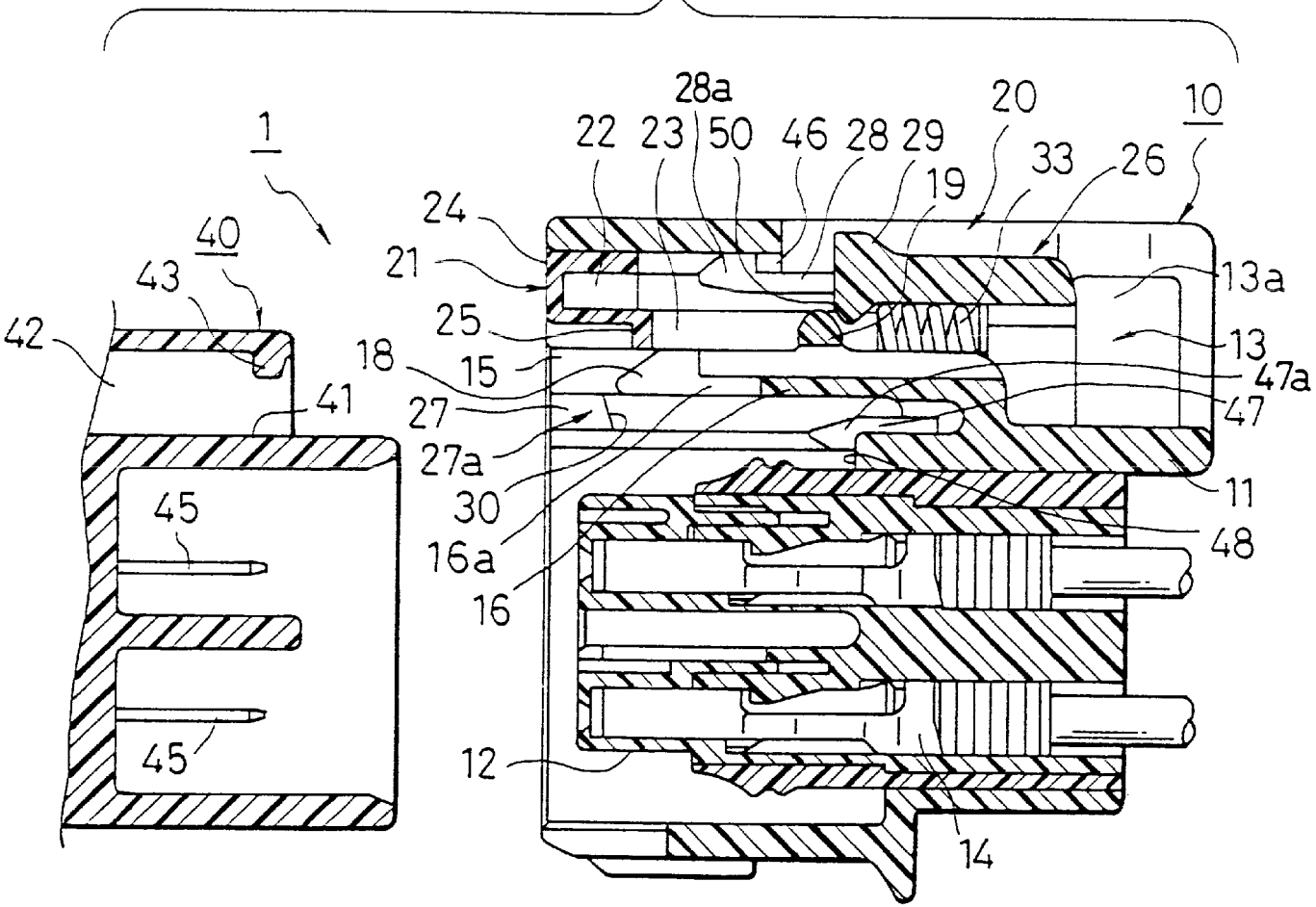
FIG. 1 is a vertical cross-sectional view showing one preferred embodiment of a connector fitting structure of the invention.
Figure 2:
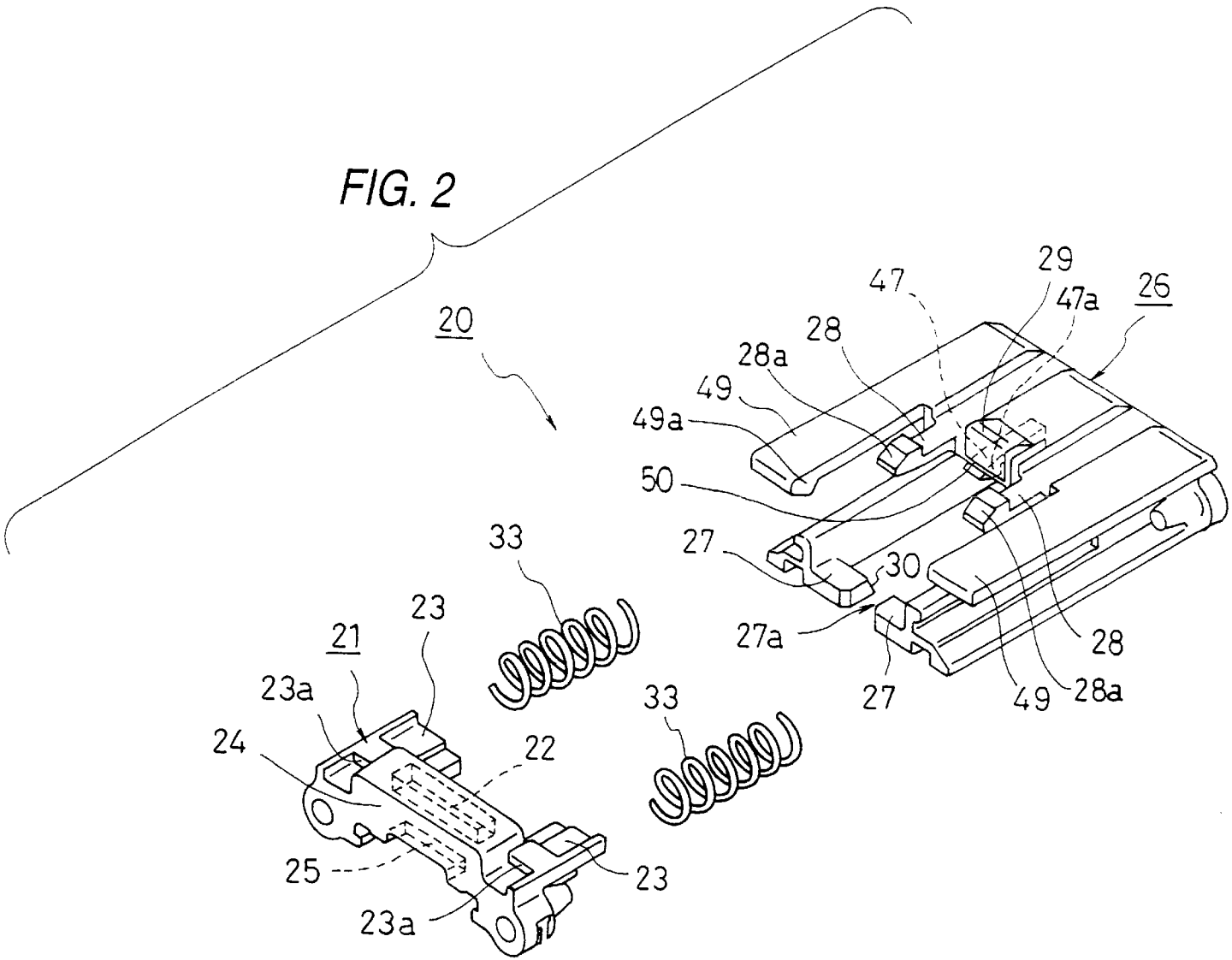
FIG. 2 is an disassembled, perspective view of a slider in FIG. 1.
Figure 3:
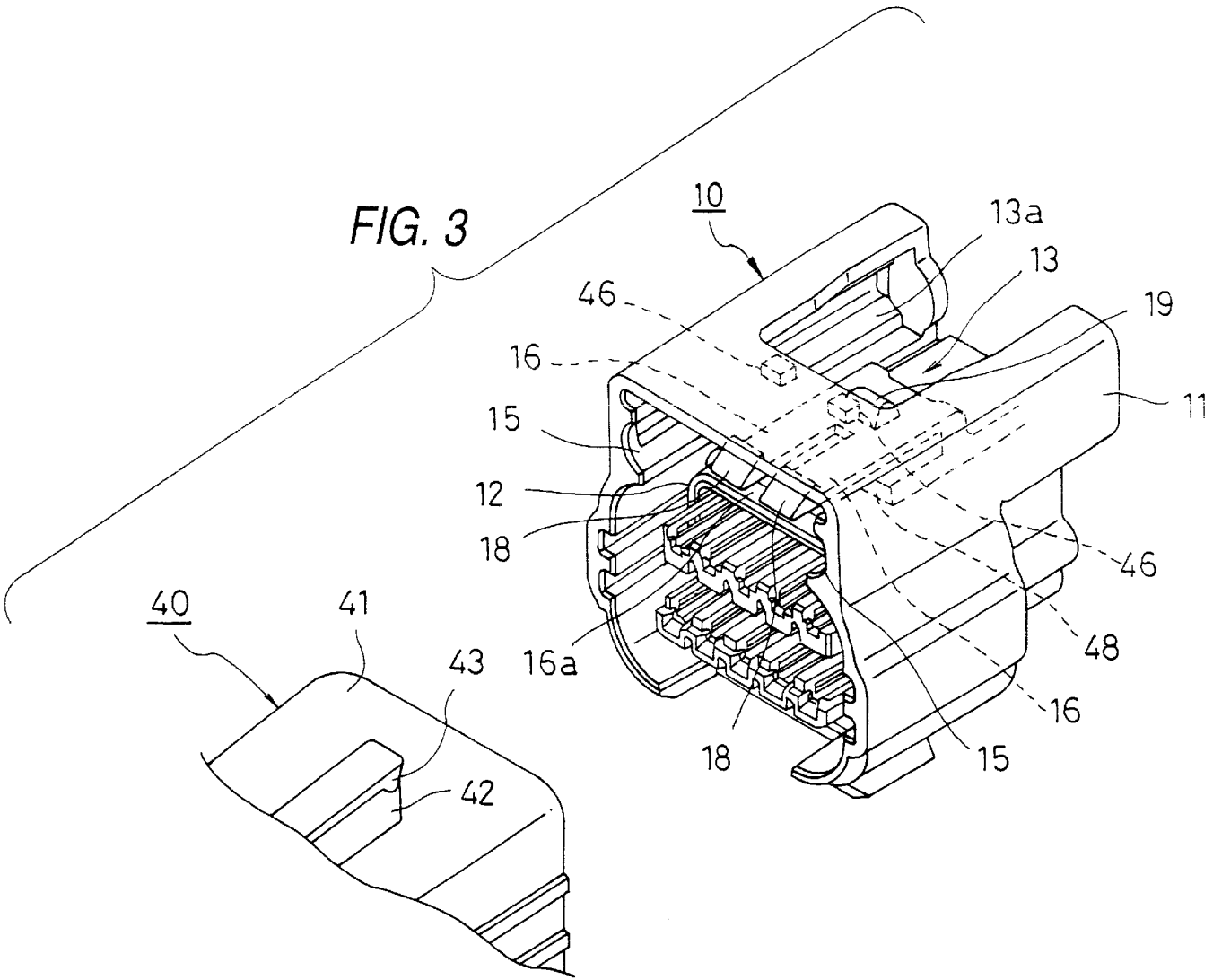
FIG. 3 is a perspective view showing important portions of female and male connectors in FIG. 1.
Figure 4:
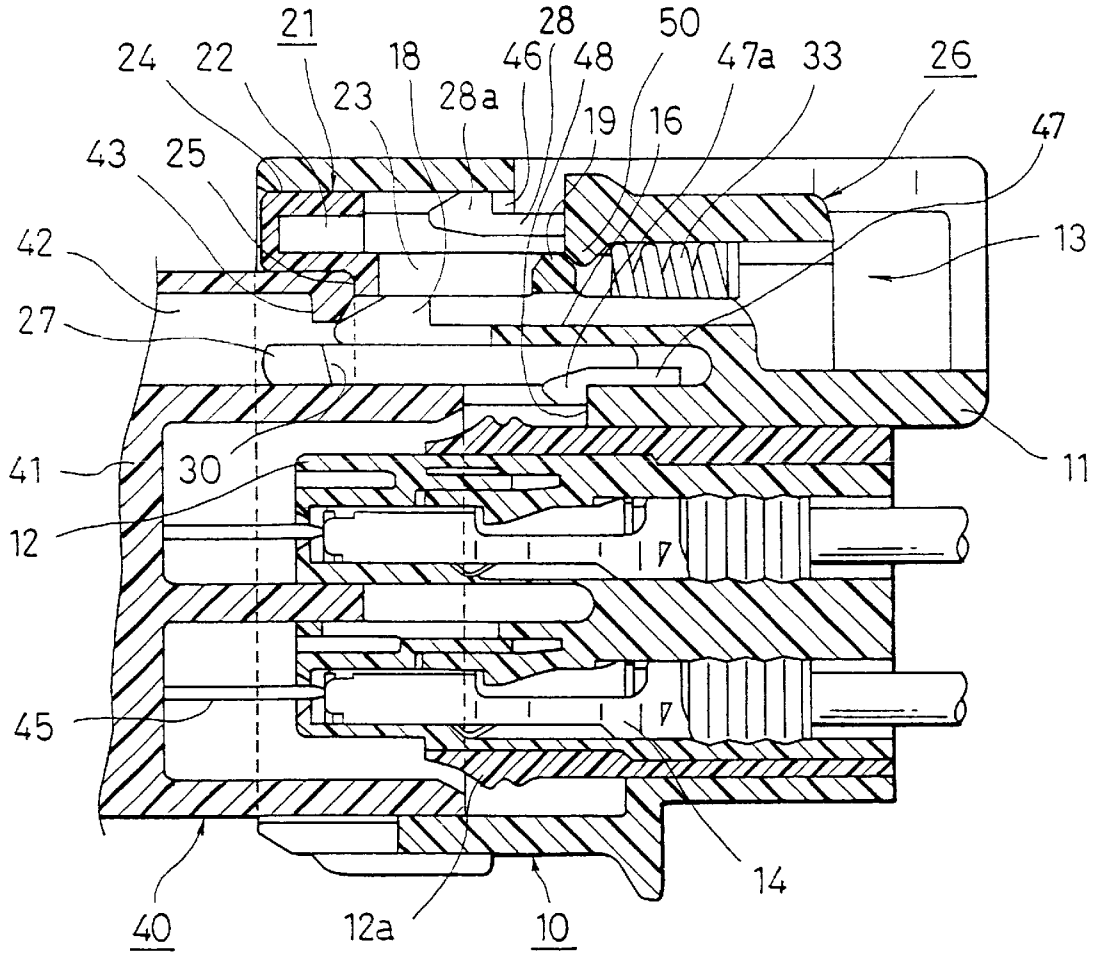
FIG. 4 is a view explanatory of an operation, showing a condition in which a fitting operation in FIG. 1 is started.
Figure 5:
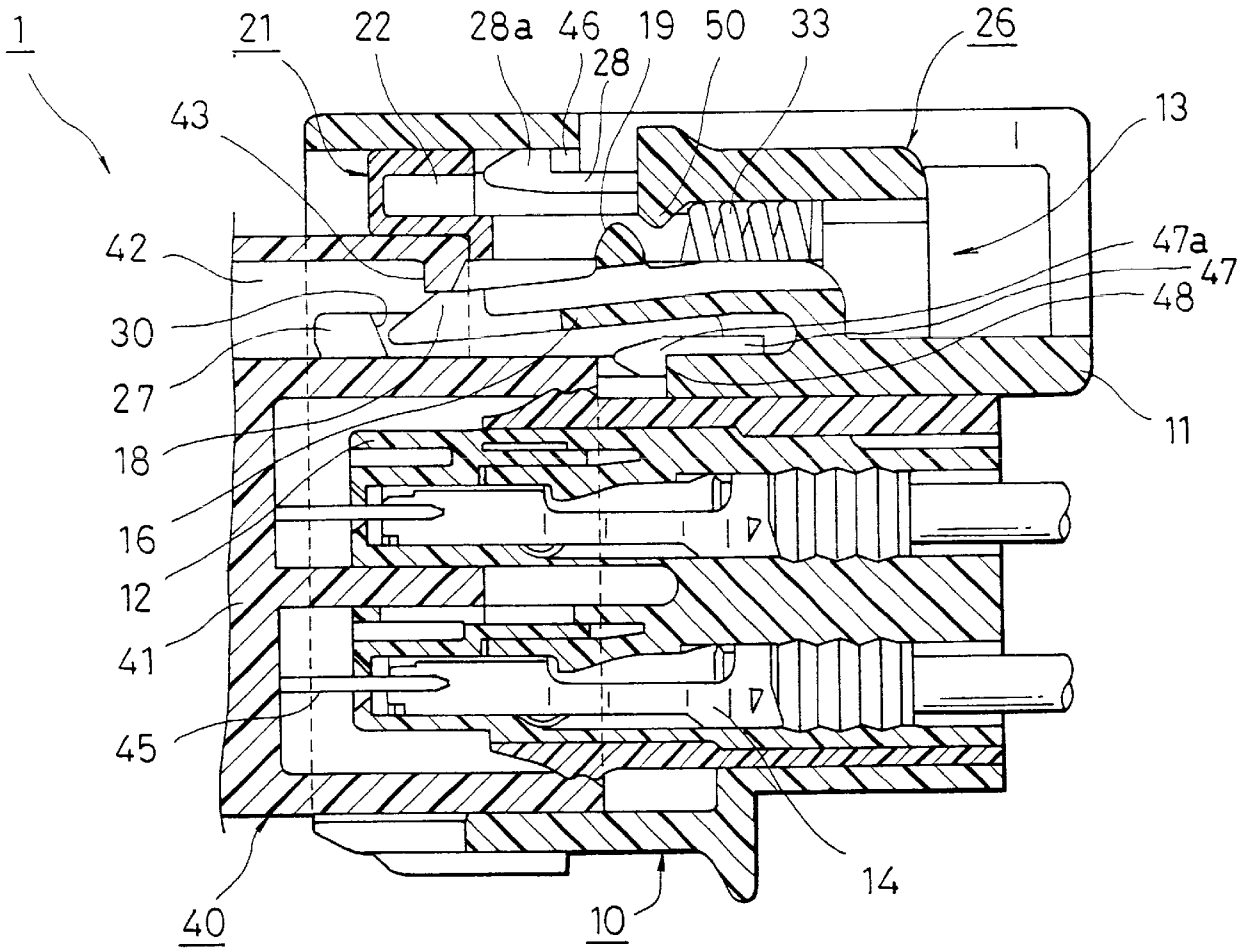
FIG. 5 is a view explanatory of the operation, showing the process of the fitting operation in FIG. 1.
Figure 6:
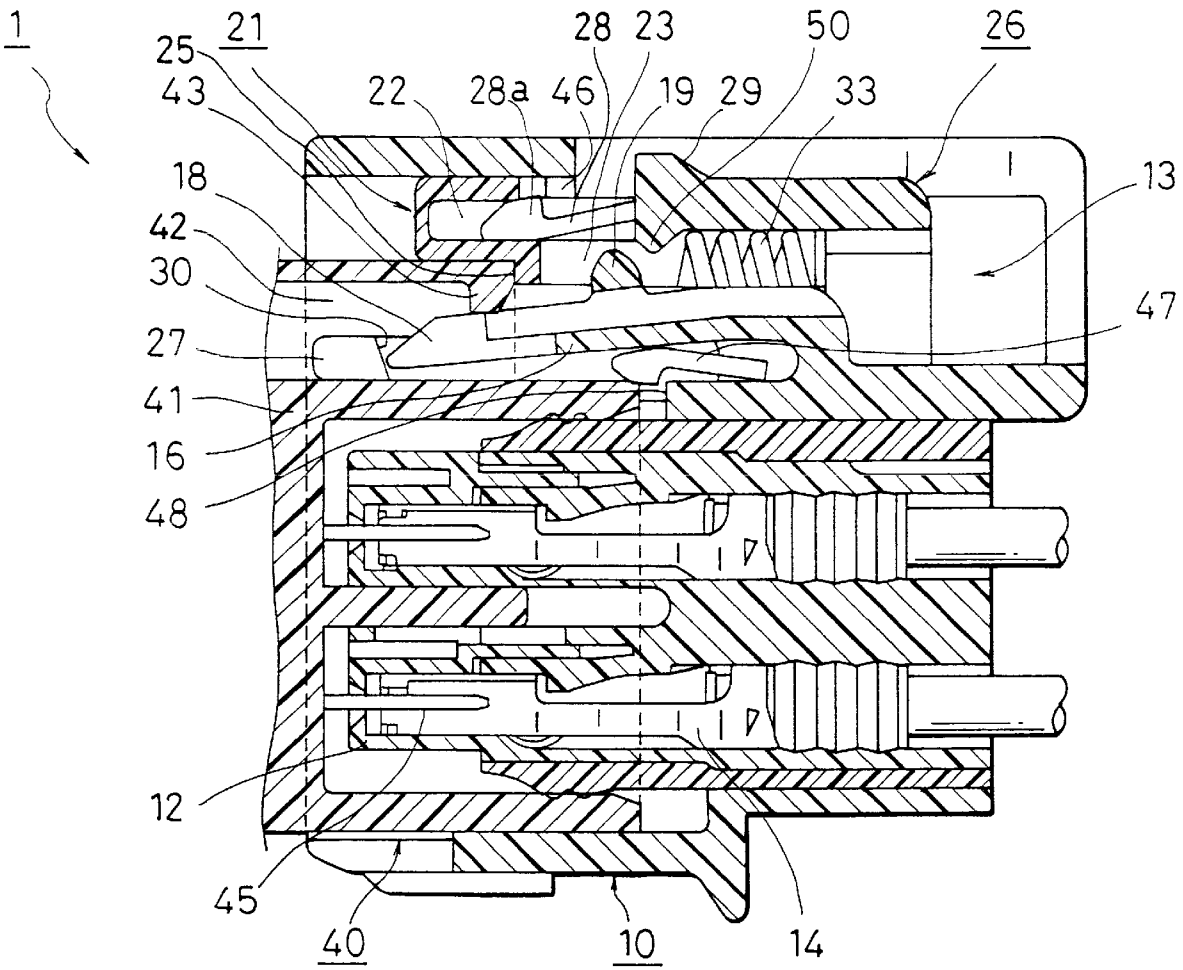
FIG. 6 is a view explanatory of the operation, showing a condition in which the fitting operation in FIG. 1 is further continued.
Figure 7:
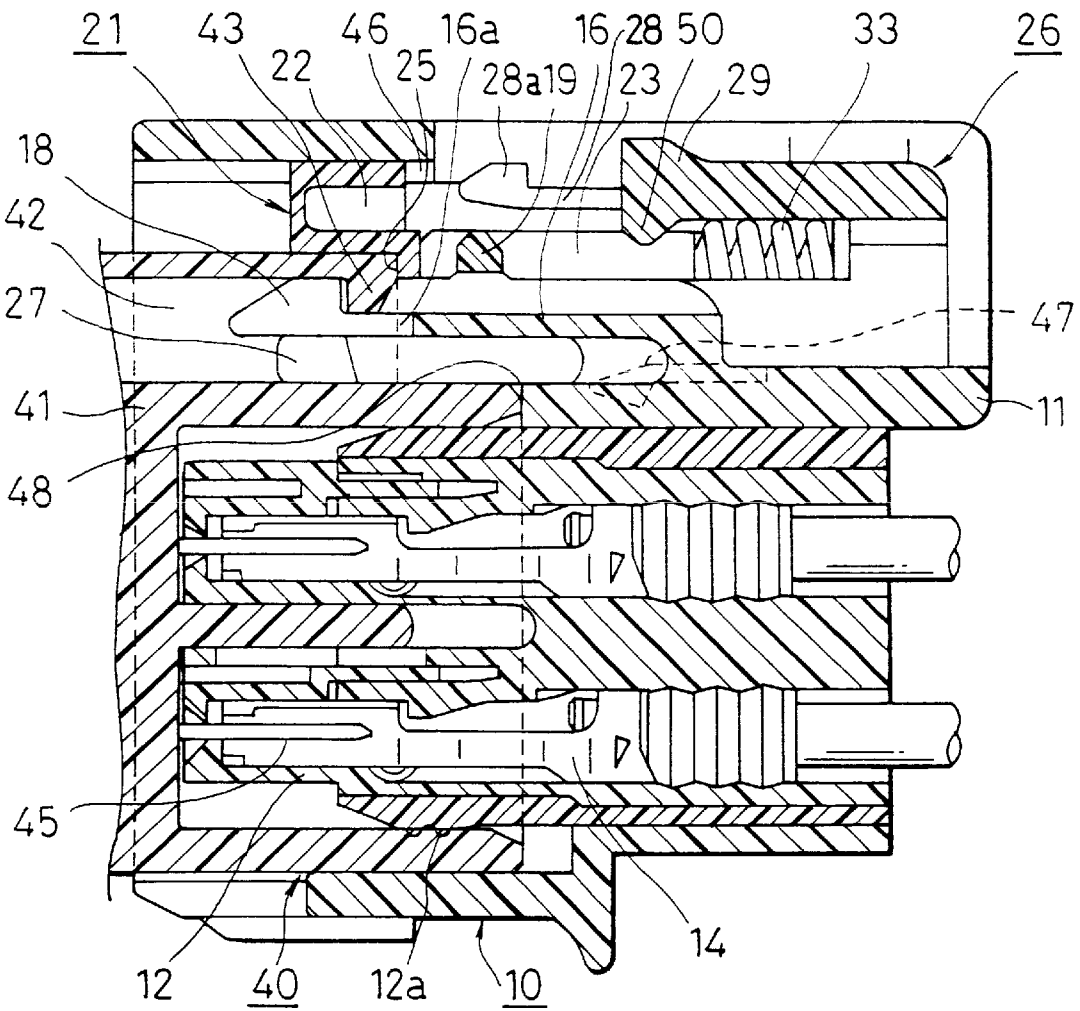
FIG. 7 is a view explanatory of the operation, showing a condition in which the fitting operation in FIG. 1 is finished.
Figure 8:
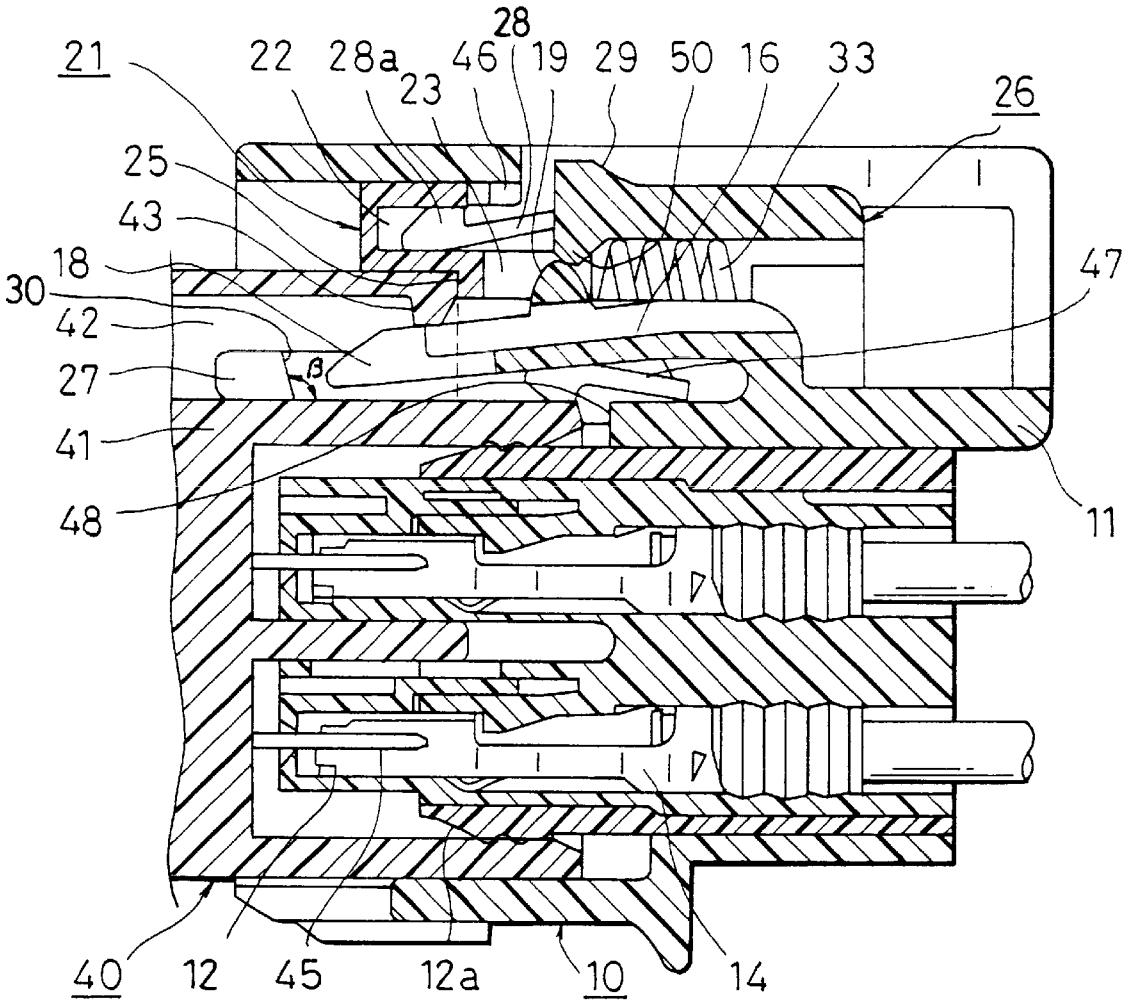
FIG. 8 is a view explanatory of the operation at the time of canceling a fitted condition.

A preferred embodiment of a connector fitting structure of the present invention will now be described in detail with reference to FIGS. 1 to 9. FIG. 1 is a vertical cross-sectional view showing one preferred embodiment of the connector fitting structure of the invention; FIG. 2 is an exploded, perspective view of a slider in FIG. 1; FIG. 3 is a perspective view showing female and male connector housings in FIG. 1; FIG. 4 is a view explanatory of an operation, showing a condition in which a fitting operation in FIG. 1 is started; FIG. 5 is a view explanatory of the operation, showing the process of the fitting operation in FIG. 1; FIG. 6 is a view explanatory of the operation, showing a condition in which the fitting operation in FIG. 1 is further continued; FIG. 7 is a view explanatory of the operation, showing a condition in which the fitting operation in FIG. 1 is finished; FIG. 8 is a view explanatory of the operation at the time of canceling a fitted condition in FIG. 1; and FIG. 9 is a view showing a slanting surface of a retaining portion in FIG. 1.

As shown in FIGS. 1 to 3, The connector fitting structure 1 includes a pair of female and male connectors to be fittingly connected together. The male connector (one connector) 10 includes: an inner housing 12, which has socket contacts 14 fitted therein, and is open to the front side thereof; and an outer housing 11 of a hood-like shape which has the slider 20 slidably mounted therein above the inner housing 12, and covers the inner housing 12.

Elastic lock arms 16 are provided on an upper surface of the inner housing 12, and extend in a fitting direction of arrow F. The elastic lock arms 16 have hook-like housing locks 18 formed respectively at front ends thereof. A pressing portion 19, which is operated when canceling the fitting connection, is provided on an upper surface of the lock arms 16 at a generally central portion thereof.

More specifically, a slider receiving portion 13 is formed between the upper surface of the inner housing 12 and an inner surface of an upper wall of the outer housing 11. Guide grooves 15 for respectively guiding opposite side portions of the slider 20 are formed respectively in inner surfaces of opposite side walls of the outer housing 11.

A side space 13*a* for receiving the slider 20 is formed between each of the lock arms 16 and the inner surface of each of the opposite side walls of the outer housing 11. An insertion space 16*a* is formed between the lock arms 16 and between the housing locks 18. A seal member 12*a* (see FIG. 4) is fitted on the outer periphery of the inner housing 12.

First engagement portions 46 for being engaged respectively with first engagement arms 28 (described later) are formed on the inner surface of the upper wall of the outer housing 11, and a second engagement portion 48 for engagement with a second engagement arm 47 (described later) is formed on the outer housing 11.

The slider 20 includes: a first slide member 21, which is slidable within the outer housing 11 in the axial direction; a second slide member 26, engaged with a rear portion of the first slide member 21; and compression springs (serving as resilient members) 33 which are held in the second slide member 26, and resiliently urge the first and second slide members 21 and 26 away from each other.

The first slide member 21 includes: a pair of stopper arm portions 23 and 23, which extend rearwardly, and are abutted respectively against one ends of the compression springs 33; and an interconnecting portion 24 interconnecting the stopper arm portions 23 at front ends thereof. An abutment portion 25, against which a pressing rib 42 (described later) of the female connector 40 can abut, is formed at a lower surface of the interconnecting portion 24 at a front end portion thereof. Auxiliary retaining surfaces 23*a* for respectively retaining auxiliary retaining arms 49 (described later) are formed on upper surfaces of the stopper arm portions 23, respectively.

A slide groove 22 is formed in the rear end of the interconnecting portion 24, and this slide groove 22 allows the distal ends of the first engagement arms 28 (described later) to escape thereinto when the first and second slide members 21 and 26 are moved toward each other during the fitting operation of the female and male connectors.

Retaining portions 27 for preventing the downward displacement of the housing locks 18 are formed at the front end portion of the second slide member 26. A disengagement prevention portion 29, which is operated when canceling the fitting connection, is formed on the upper surface of the second slide member 26 at a central portion thereof. When the slider 20 is mounted in the outer housing 11, the second slide member 26 covers the pressing portion 19. A notch 27*a* is formed between the pair of retaining portions 27 and 27 so that the pressing rib 42 (described later) of the female connector 40 will not interfere with the second slide member when fitting the male and female connectors 10 and 40 together.

A cancellation projection 50 is formed on a lower surface of the disengagement prevention portion 29 at a front end thereof, and when the second slide member 26 is moved forward during the cancellation of the fitting connection, this cancellation projection 50 is abutted against the pressing portion 19 of the lock arms 16 to flex the lock arms 16 downwardly so as to cancel the engaged condition of the housing locks 18.

The second slide member 26 has the pair of flat plate-like, elastic auxiliary retaining arms 49 each having an auxiliary retaining projection 49*a* formed on a lower surface thereof at a front end thereof. These projections 49*a* can be retained by the auxiliary retaining surfaces 23*a* of the first slide member 21, respectively. A slanting surface 30, which is slanting downwardly rearwardly and has an inclination angle β, is formed on a rear surface of each of the retaining portions 27 (see FIG. 9).

The second slide member 26 further includes the pair of first engagement arms 28 of an elastic nature, and the second engagement arm 47 of an elastic nature. Each of the first engagement arms 28 has at its front end a first retaining projections 28*a* of a hook-like shape for engagement with the associated first engagement portion 46 formed on the inner surface of the upper wall of the outer housing 11. The second engagement arm 47 has at its front end a second retaining projection 47*a* of a hook-like shape for engagement with the second engagement portion 48 formed on the outer housing 11.

Pin contacts 45 project into the fitting direction of opposite to arrow F, from the interior of the housing 41 of the female connector (the other connector) 40. The pressing rib 42 for abutment against the abutment portion 25 of the first slide member 21 is formed on an upper wall of the housing 41 at a widthwise central portion thereof, and extends in the fitting direction. A pair of engagement projections 43 are formed respectively at opposite side portions of the pressing rib 42 at a front end of thee female connecctor, and these engagement projections 43 elastically deform the lock arms 16, respectively, and engage the housing locks 18, respectively.

Next, the fitting operation of the connector fitting structure 1 of the above construction will be described. First, as shown in FIG. 2, the compression springs 33 are set at the opposite side portions of the second slide member 26, respectively, and then when the stopper arm portions 23 of the first slide member 21 are pressed against the compression springs, respectively, so that the auxiliary retaining projections 49*a* of the auxiliary retaining arms 49 are retained by the auxiliary retaining surfaces 23*a,* respectively, thus completing the assembling of the slider 20.

Then, as shown in FIG. 3, the slider 20 is inserted into the slider receiving portion 13 along the guide grooves 15 in the outer housing 11 until the front end surface of the interconnecting portion 24 of the slider 20 becomes flush with the front end of the outer housing. As a result, the first retaining projections 28*a* of the first engagement arms 28 of the second slide member 26 are retained by the first engagement portions 46 of the outer housing 11, respectively, and also the second retaining projection 47*a* of the second engagement arm 47 is retained by the second engagement portion 48, as shown in FIG. 1.

Therefore, the second slide member 26 is retained relative to the outer housing 11 of the male connector 10 at three portions (that is, the pair of first engagement arms 28 and the second engagement arm 47), and therefore the first and second engagement arms 28 and 47 will not be disengaged from the first and second engagement portions 46 and 48 of the outer housing 11, respectively, and therefore the slider will not be moved rearward.

Then, when the housing 41 of the female connector 40 is inserted into the male connector 10 while the inner peripheral surface of the housing 41 is guided by the outer periphery of the inner housing 12 of the male connector 10, the front end of the pressing rib 42 abuts against the abutment portion 25 of the first slide member 21, and also the retaining portions 27 of the second slide member 26 are brought into sliding contact with the upper surface of the housing 41, as shown in FIG. 4.

Then, when the fitting operation further proceeds as shown in FIG. 5, only the first slide member 21 is pushed by the pressing rib 42 of the female connector 40 against the repulsive force of the compression springs 33, with the second slide member 26 held in its position. Therefore, the first slide member 21, while compressing the compression springs 33, is moved toward the rear end of the slider receiving portion 13. As a result, the engagement projections 43 depress the housing locks 18, respectively, so that the lock arms 16 are flexed downwardly.

Then, when the fitting operation further proceeds as shown in FIG. 6, the first engagement arms 28 are disengaged from the first engagement portions 46, respectively, and the first engagement arm 28 are introduced into the slide groove 22 in an escaping manner, and also the second engagement arm 47 is pressed by the front end of the housing 41 of the female connector 40 to be disengaged from the second engagement portion 48. Under the influence of the compression springs 33, the slanting surfaces 30 of the retaining portions 27 press the front ends of the housing locks 18 rearwardly, respectively.

At this stage, if the fitting force, applied to the female connector 40, is released, the female connector 40 is pushed back in a disengaging direction through the abutment portion 25 and the pressing rib 42 since the first slide member 21 is urged forward by the resilient forces of the compression springs 33. And besides, when the connector-fitting operation is not yet completed, the pressing portion 19 on the lock arms 16 is generally covered by the disengagement prevention portion 29 of the second slide member 26. Therefore, such an incompletely-fitted condition can also be detected with the eyes.

Then, when the female connector 40 is further pushed in the fitting direction as shown in FIG. 7, the downwardly-flexed lock arms 16 are restored into their original position, so that the housing locks 18 are engaged with the engagement projections 43, respectively. As a result, the retaining portions 27 are disengaged from the housing locks 18, respectively, therefore, the second slide member 26 is moved toward the rear end of the male connector 10 by the resilient forces of the compression springs 33. At this time, the retaining portions 27 are moved to be disposed under the housing locks 18, respectively, so that the housing locks 18 are kept engaged respectively with the engagement projections 43 in a locked manner, thus preventing the flexing of the lock arms.

Therefore, the male and female connectors 10 and 40 are held in a completely-fitted condition, and this fitted condition will not be canceled by vibrations and so on. The disengagement prevention portion 29 of the second slide member 26 is spaced rearwardly from the pressing portion 19 on the lock arms 16, and therefore the completely-fitted condition can be detected with the eyes. Also, the completely-fitted condition can be detected through the sense of touch when the resilient forces of the compression springs 33 are abruptly reduced.

Next, the fitting connection-canceling operation of the connector fitting structure 1 of the above construction will be described.

In the completely-fitted condition of the male and female connectors 10 and 40, when the disengagement prevention portion 29 of the second slide member 26 is pushed forward with the finger or other against the repulsive force of the compression springs 33, the first engagement arms 28 abut against the first engagement portions 46, respectively, to be pressed down, and therefore, escape into the slide groove 22 in the first slide member 21, as shown in FIG. 8. At this time, the cancellation projection 50, formed on the lower surface of the disengagement prevention portion 29 at the front end thereof, abuts against the pressing portion 19 on the lock arms 16. Then, when the second slide member 26 is further pushed forward, the retaining portions 27 of the second slide member 26 are moved forward beyond the housing locks 18, respectively, thus canceling the locked condition, so that the lock arms 16 are flexed downwardly. As a result of this flexing, the engagement of each housing lock 18 with the associated engagement projection 43 is canceled, and the male connector 10 and the female connector 40 are moved from each other by the resilient force of the compression springs 33.

Figure 9A:
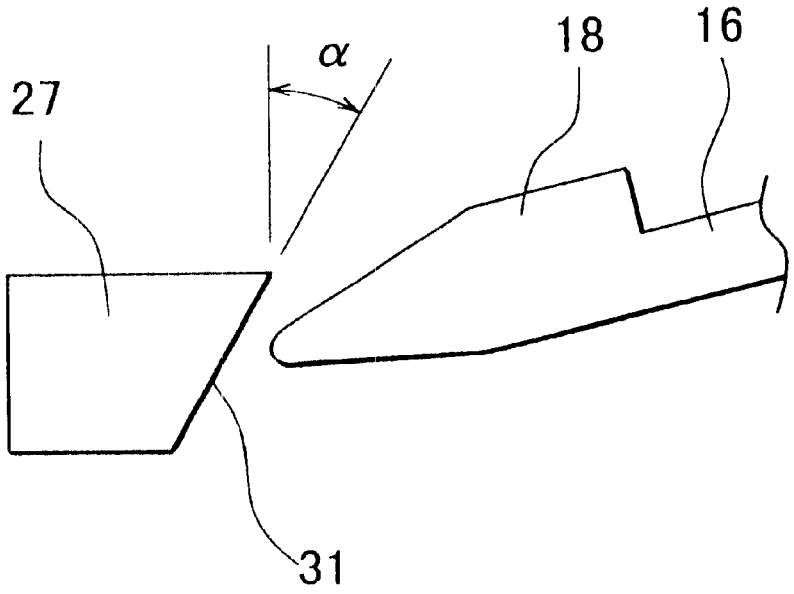
FIGS. 9(*a*) and 9(*b*) are views showing a slanting surface of a retaining portion in FIG. 1.

If the rear end surface of each retaining portion 27 is vertical, or is slanting downwardly forwardly at an inclination angle $\alpha°$ as shown in FIG. 9A, the downwardly-flexed lock arm 16 can not be restored by its own restoring force, and hence can not be brought into engagement with the engagement projection 43 since the rear end surface presses the front end of the housing lock 18 by the resilient force of the compression spring 33.

Figure 9B:
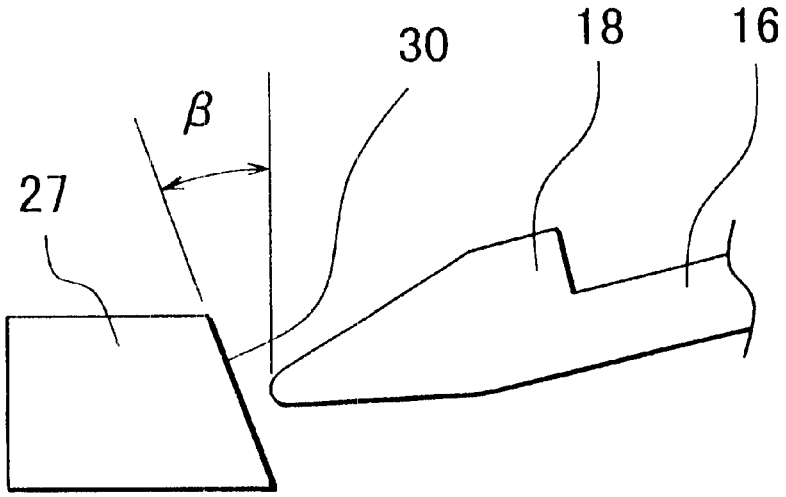
Figure 10:
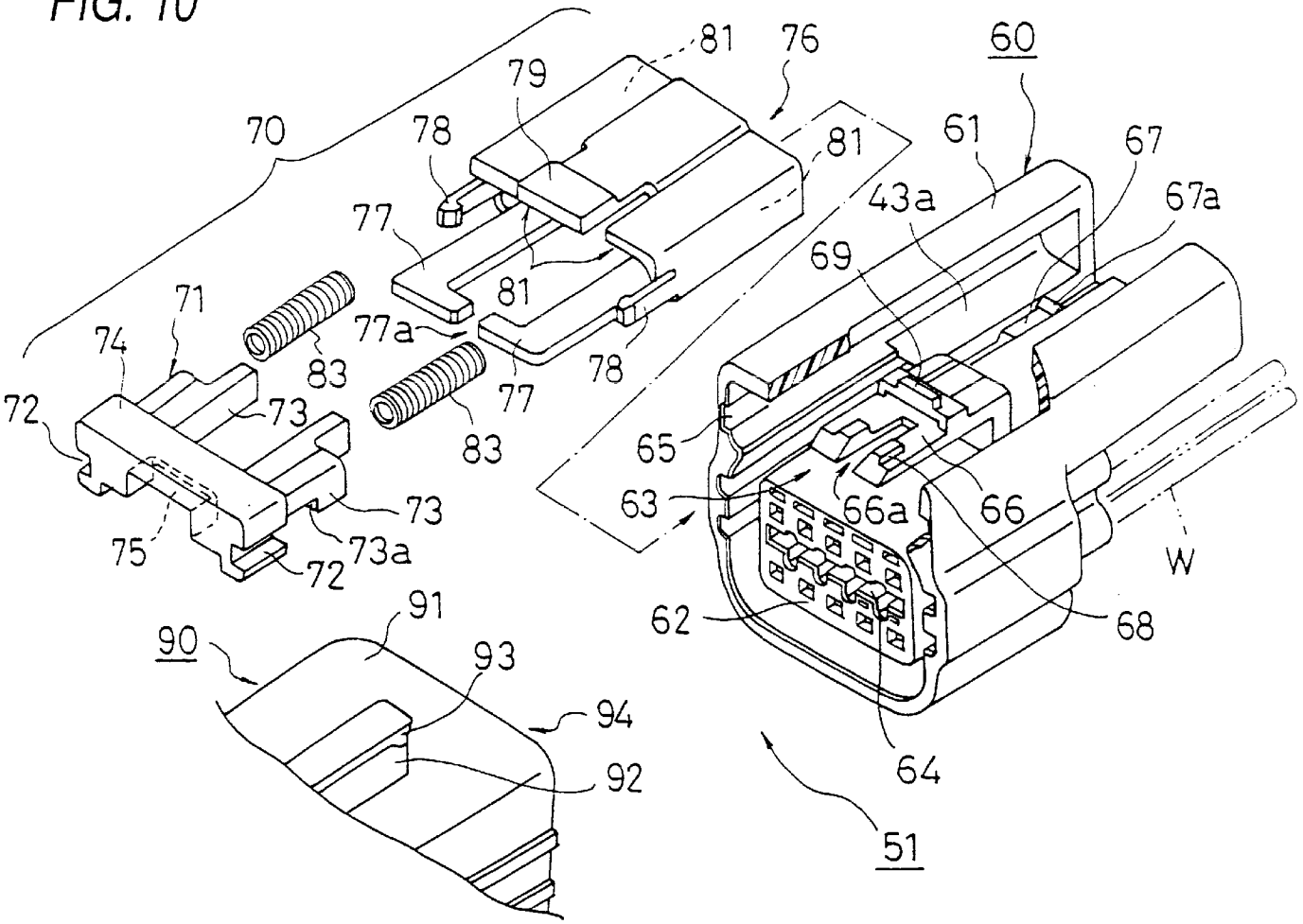
PRIOR ART FIG. 10
FIG. 10 is an exploded, perspective view showing one example of a general connector fitting structure.
Figure 11:
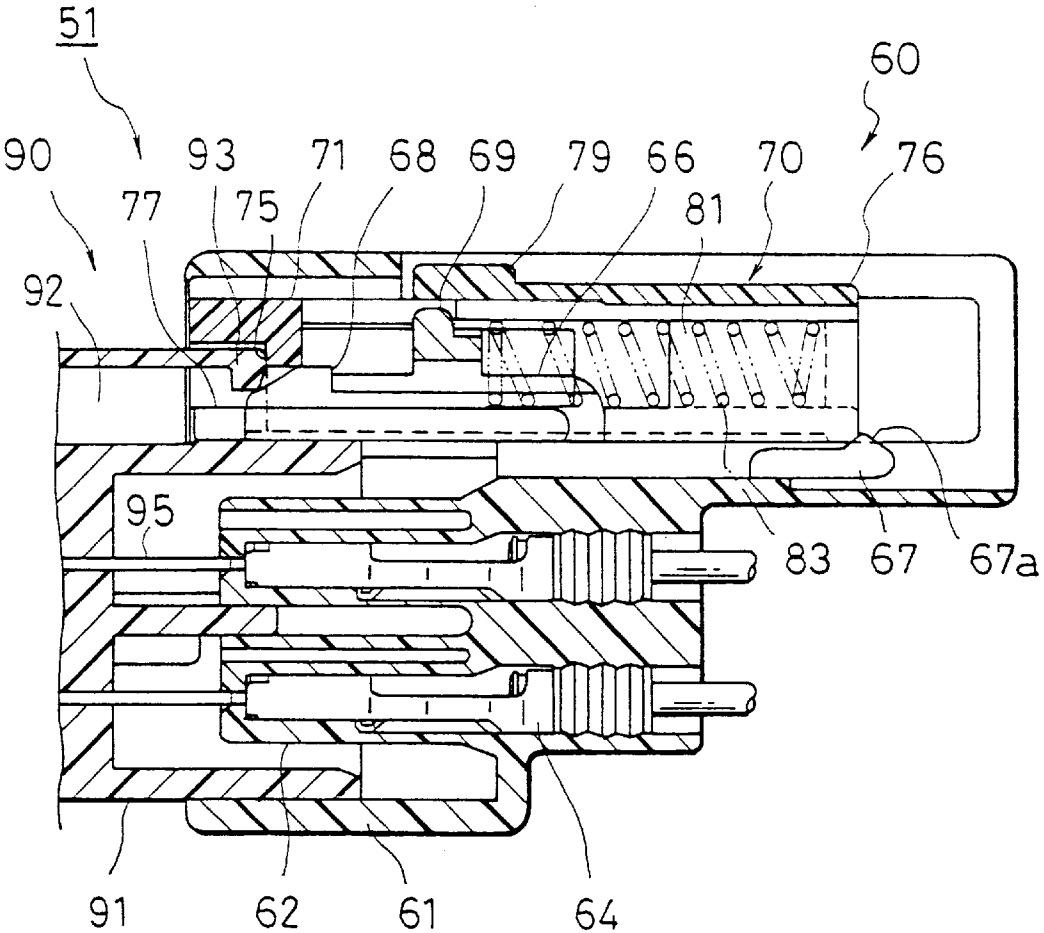
PRIOR ART FIG. 11
FIG. 11 is a view explanatory of an operation, showing a condition in which a fitting operation in FIG. 10 is started.
Figure 12:
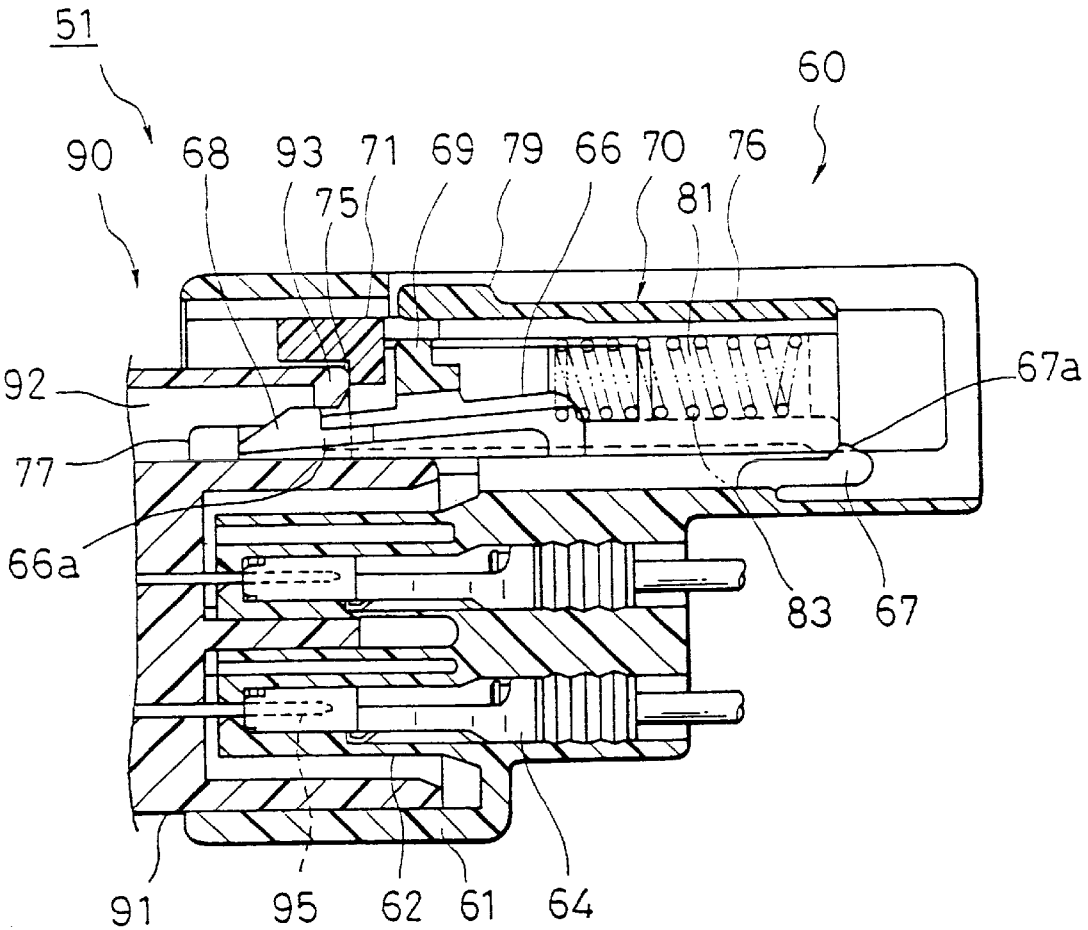
PRIOR ART FIG. 12
FIG. 12 is a view explanatory of the operation, showing the process of the fitting operation in FIG. 10.
Figure 13:
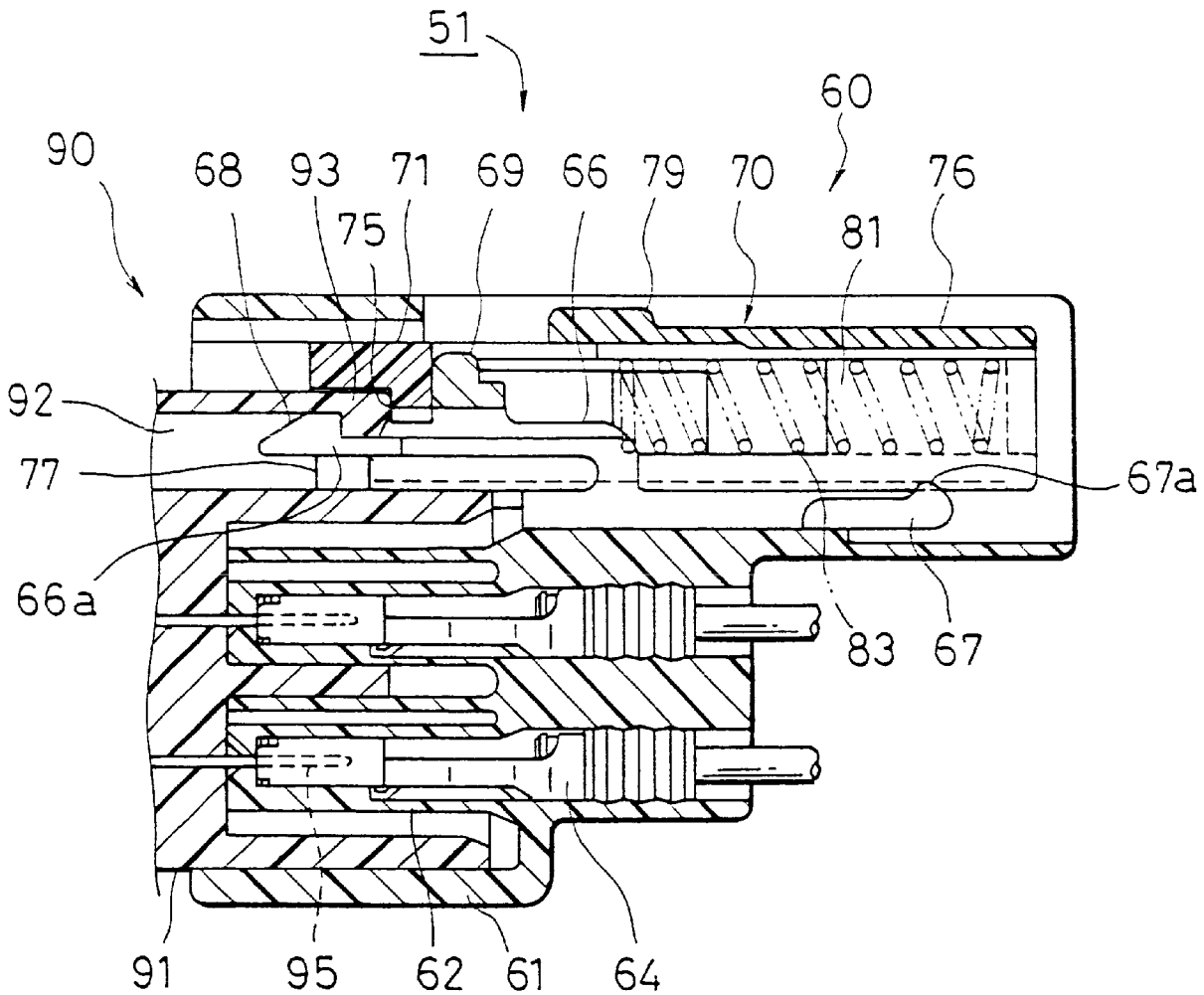
PRIOR ART FIG. 13
FIG. 13 is a view explanatory of the operation, showing a condition in which the fitting operation in FIG. 10 is finished.
Figure 14:
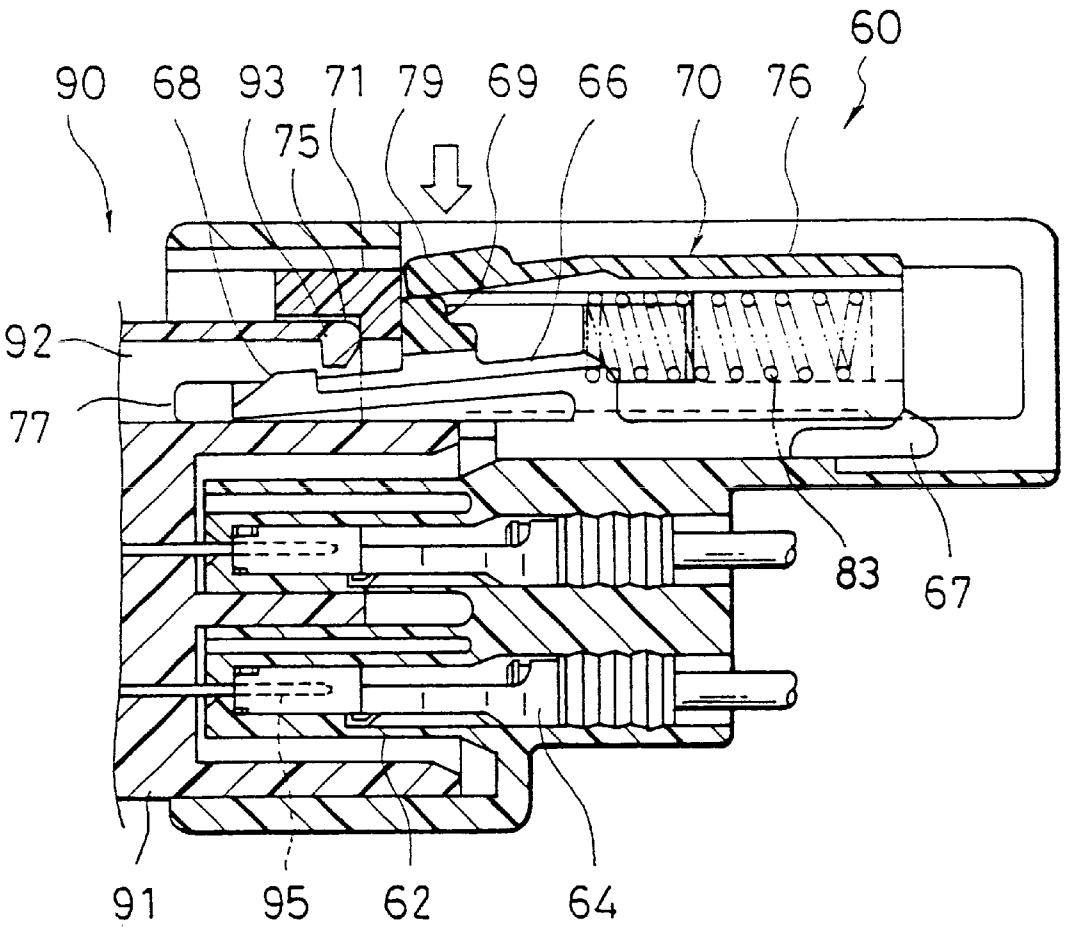
PRIOR ART FIG. 14
FIG. 14 is a view explanatory of the operation at the time of canceling a fitted condition.

When the slanting surface 30, which is slanting downwardly rearwardly at an inclination angle $\beta°$ as shown in FIG. 9B, is formed at the rear end surface of each retaining portion 27, the downwardly-flexed lock arm 16 is restored upwardly along this slanting surface 30, and is engaged with the engagement projection 43, and therefore the fitting operation can be carried out with a low fitting force.

As described above, in the connector fitting structure of this embodiment, there are provided the first engagement arms 28, for engagement respectively with the first engagement portions 46 formed on the inner surface of the outer housing 1 of the male connector 10, and the first engagement arm 28 have the first retaining projections 28*a* formed respectively at the front ends thereof. With this construction, the housing 41 of the female connector 40 is fitted into the male connector 10, and the engagement projections 43 depress the housing locks 18, respectively, and thereafter unless the first engagement arms 28 are caused to escape into the slide groove 22, the first engagement arms 28 will not be disengaged from the first engagement portions 46, respectively.

Therefore, before the housing locks 18 are pressed down, the second slide member 26 will not be brought out of retaining engagement with the outer housing 11 by vibrations and so on, and hence the second slide member 26 will not be moved toward the rear end of the housing, and therefore the operation for mutually fitting the male and female connectors 10 and 40 together can be positively carried out, and the reliability of the male and female connectors 10 and 40 can be enhanced.

As described above, in the connector fitting structure of this embodiment, the housing 41 of the female connector 40 is fitted into the male connector 10, and the engagement projections 43 depress the housing locks 18, respectively; Then the first engagement arms 28 are caused to escape into the slide groove 22, and therefore the first engagement arms 28 are disengaged from the first engagement portions 46, respectively.

At this time, the second engagement arm 47 is pressed by the front end of the housing 41 of the female connector 40 to be disengaged from the second engagement portion 48, and therefore the downwardly-flexed lock arms 16 are restored into their original position, so that the housing locks 18 are engaged respectively with the engagement projections 43, thus achieving the completely-fitted condition.

For canceling the fitted condition of the male and female connectors 10 and 40, the disengagement prevention portion 29 of the second slide member 26 is pushed forward, so that the first engagement arms 28 are caused to escape into the slide groove 22 in the first slide member 21, and also the cancellation projection 50 abuts against the pressing portion 19. Then, when the second slide member 26 is further pushed forward, the lock arms 16 are flexed downwardly, so that the engagement of each housing lock 18 with the associated engagement projection 43 is canceled. Therefore the male connector 10 and the female connector 40 are easily moved away from each other by the resilient force of the compression springs 33.

Therefore, when canceling the fitted condition, it is only necessary to push the second slide member forward with a relatively-small pushing force, and therefore the canceling operation is easy, and the efficiency of the operation can be enhanced, and besides the lock arms will not be excessively displaced, and hence will not be damaged, thus enhancing the durability of the female and male connectors.

The second slide member 26 includes the second engagement arm 47 having the second retaining projection 47*a* formed at the front end thereof, and the second engagement portion 48 is formed on the inner housing 11 of the male connector 10. Therefore, until the second engagement arm 47 is disengaged from the second engagement portion 48 by the front end of the housing 41 of the female connector 40, that is, until the time immediately before the housing locks 18 are engaged respectively with the engagement projections 43 of the female connector 40, the second slide member 26 will not be disengaged from the outer housing 11 by vibrations and so on, and hence the second slide member 26 will not move toward the rear end of the housing.

Therefore, the compression springs 33 are kept compressed until the time immediately before the completely-fitted condition is achieved, and therefore the resilient force of these compression springs are kept strong, and if the fitting force is weakened in a half-fitted condition, the female connector 40 can be positively pushed back in the disengaging direction, and therefore the reliability of the male and female connectors 10 and 40 can be further enhanced.

And besides, the slanting surface 30, which is slanting downwardly rearwardly at an inclination angle β°, is formed at the rear end surface of each of the retaining portions 27 of the second slide member 26, and therefore immediately before the male and female connectors 10 and 40 are completely fitted together, each housing lock 18 is returned to smoothly slide upwardly over the slanting surface 30, with the resilient force of the compression springs 33 acting on the housing lock 18, and is engaged with the engagement projection 43 of the female connector 40. Therefore, the male and female connectors 10 and 40 can be positively completely fitted together, and therefore the reliability of the female and male connectors 10 and 40 can be further enhanced.

The present invention is not limited to the above embodiment, but can be applied to various embodiments. For example, in this embodiment, although the slider 20 is received in the male connector 10, the slider can be received in the female connector 40.

Although there are provided the pair of lock arms 16 and the pair of first engagement arms 28, there may be provided one lock arm and one first engagement arm. The number of the second engagement arm 47 is not limited to one, but a pair of second engagement arms may be provided.

As described above, in the connector fitting structure of the above construction, the second slide member includes the elastic first engagement arms, which can be engaged respectively with the first engagement portions formed on the inner surface of the outer housing of the one connector, and the elastic second engagement arm which can be engaged with the second engagement portion formed on the outer housing. The first slide member has the slide groove which cancels the engaged condition of the first engagement arms, and also allows the first engagement arms to escape into the slide groove when the first and second slide members move toward each other against the resilient force of the resilient members during the fitting operation of the female and male connectors. The engaged condition of the second engagement arm of the second slide member is canceled by the front end of the housing of the other connector.

Therefore, the housing of the other connector is fitted in the one connector, and thereafter unless the first engagement arms are caused to escape into the slide groove, the first engagement arms will not be disengaged from the first engagement portions, respectively. Therefore, there will not be encountered a situation in which the fitting operation of the female and male connectors can not be effected, and therefore the reliability of the female and male connectors can be enhanced.

Until the second engagement arm is disengaged from the second engagement portion by the front end of the housing of the other connector, that is, until the time immediately before the housing locks are engaged respectively with the engagement projections of the other connector, the second slide member will not be disengaged from the outer housing by vibrations and so on, and hence the second slide member will not move toward the rear end of the housing.

Therefore, if the fitting force is weakened in a half-fitted condition before the completely-fitted condition is achieved, the female and male connectors can be positively pushed back away from each other by the resilient force of the resilient members. Therefore, the reliability of the male and female connectors can be further enhanced.

In the above connector fitting structure, preferably, the second slide member has the retaining portions which are formed at the front end thereof, and can prevent the downward displacement of the housing locks, and the slanting surface, which is slanting downwardly rearwardly, is formed on the rear end surface of each of the retaining portions. With this construction, immediately before the male and female connectors are completely fitted together, each housing lock is returned to smoothly slide upwardly over the slanting surface on the rear end surface of the retaining portion, and is engaged with the other connector. Therefore, the fitting operation of the male and female connectors can be carried out with the low insertion force, and also the female and male connectors can be positively completely fitted together, and therefore the reliability of the female and male connectors can be further enhanced.

In the above connector fitting structure, preferably, the second slide member includes the flat plate-like auxiliary retaining arms which can be retained respectively by the auxiliary retaining surfaces of the first slide member. With this construction, the second slide member can be engaged with the first slide member in a stable manner, and is positively prevented from being disengaged from the first slide member by vibrations and so on, and the reliability of the slider can be enhanced.

As described above, in the connector fitting structure of the invention, the cancellation projection is formed on the lower surface of the front end of the disengagement prevention portion which is operated when canceling the fitting connection, and when the second slide member is moved forward for canceling the fitting connection, the cancellation projection is abutted against the pressing portion on the lock arms to flex the lock arms, thereby canceling the engagement of the housing locks of the one connector with the respective engagement projections of the other connector.

Therefore, when canceling the fitted condition of the female and male connectors, it is only necessary to push the second slide member forward, and therefore the operation, required for canceling the fitted condition, is easy, and the efficiency of the operation can be enhanced.

And besides, the amount of flexing of the lock arms is determined by the vertical dimensions of the cancellation projection and pressing portion, and therefore the lock arms will not be excessively displaced, and hence will not be damaged, and the reliability and durability of the female and male connector can be enhanced.

In the connector fitting structure, preferably, the second slide member has the first engagement arms engageable respectively with the first engagement portions formed on the inner surface of the outer housing, and when the second slide member is moved forward for canceling the fitting connection, the first engagement arms are caused to escape into the slide groove formed in the first slide member.

Therefore, the engagement of the housing locks of the lock arms with the respective engagement projections of the other connector can be canceled with a relatively-small pushing force.

Therefore, the efficiency of the operation, required for canceling the fitted condition of the female and male connectors, can be further enhanced.

What is claimed is:

1. A connector fitting structure comprising:

a pair of female and male connectors to be connected together;

one of said connector including an inner housing and an outer housing, said outer housing covering said inner housing, a lock arm provided on the front end of said inner housing;

a slide member movably mounted on said outer housing, said slide member including first and second slide members, and a resilient member, said first slide member slidable with respect to said outer housing in fitting direction, said second slide member engaged with a rear end of said first slide member, said resilient member positioned between said first and second slide members to urge said first and second slide members away from each other;

the other of said connector provided with a pressing rib which abuts against said slide member, an engagement projection, which flexes said lock arm and engages with said lock arm, provided on said pressing rib;

a first elastically engagement arm provided at said second slide member, engageable with a first engagement portion which is provided at an inner surface of said outer housing;

a slide groove provided at said first slide member; and wherein said slide groove cancels the engaged condition of said first engagement arm and said first engagement portion at when said first slide member is moved toward said second slide member.

2. A connector fitting structure according to claim 1, wherein an opening of said slide groove faces to said second slide member.

3. A connector fitting structure according to claim 1 further comprising, a second elastically engagement arm provided at said second slide member, engageable with a second engagement portion which is provided at an upper surface of said inner housing.

4. A connector fitting structure according to claim 3, wherein a distal end of the other connector housing cancels the engaged condition of said second engagement arm and said second engagement portion at a time of said first slide member moving toward said second slide member.

5. A connector fitting structure according to claim 1, wherein a retaining portion, for preventing a downward displacement of said lock arm, is provided at the front end of said second slide member.

6. A connector fitting structure according to claim 5, wherein a slanting surface is formed at a rear end of said retaining portion.

7. A connector fitting structure according to claim 1 further comprising:

an auxiliary retaining surface provided at said first slide member;

an auxiliary retaining arm provided at said second slide arm; and wherein said auxiliary retaining arm is retained by an auxiliary retaining surface.

8. A connector fitting structure according to claim 7, wherein said auxiliary retaining arm formed in flat plate.

9. A connector housing structure comprising:

a pair of connector housings each having an engagement portion adapted to be engaged with each other for connection between housings; and a slider for inhibiting one of said engagement portions from being disengaged from the other of said engagement portions, said slider having a first slide member, a second slide member movable toward and away from said first slide member, and an engagement arm engaged with one of said housings, wherein said engagement arm has a retaining projection for being retained by an engagement surface formed on said one of said housings, and wherein a relative movement between said first and second slide members in association with said connection between said housings disengages said engagement arm from said one of said housings.

10. A connector fitting structure according to claim 9 further comprising:

a resilient member provided between said first and second slide members to urge said first and second slide members away from each other.

11. A connector fitting structure according to claim 9, wherein said engagement portion of one of said housings forms a lock arm, and said engagement portion of the other housing forms an engagement projection for engaging with said lock arm.

12. A connector fitting structure comprising:

a pair of female and male connectors adapted to be connected together;

one of said connectors including an inner housing and an outer housing, said outer housing covering said inner housing, a lock arm provided on a front end of said inner housing;

a slide member movably mounted on said outer housing, said slide member including first and second slide members, and a resilient member, said first slide member slidable with respect to said outer housing in a fitting direction, said second slide member engaged with a rear end of said first slide member, said resilient member positioned between said first and second slide members to urge said first and second slide members away from each other;

the other of said connectors provided with a pressing rib which abuts against said slide member, and an engagement projection, which flexes said lock arm and engages with said lock arm, provided on said pressing rib; and a disengagement prevention portion provided at an upper portion of said second slide member, for canceling an engagement with said lock arm and said engagement projection;

wherein said engagement is canceled by which said lock arm is deformed downwardly by abutting against said disengagement prevention portion when said second slide member is slid toward said fitting direction.

13. A connector fitting structure according to claim 12, wherein the abutting position of said disengagement prevention portion is defined by a canceling projection projecting from a front end of a lower surface of said disengagement prevention portion.

14. A connector fitting structure according to claim 12, wherein the abutting position of said lock arm is defined by a pressing portion projecting from said upper portion of said lock arm.

15. A connector fitting structure according to claim 12, further comprising:

an engagement arm provided at said second slide member, and engageable with an engagement portion which is provided at the inner surface of said outer housing; and a slide groove provided at said first slide member;

wherein said engagement arm is accommodated in said slide groove by moving said second slide member forward at the time of canceling said engagement.

16. A connector fitting structure according to claim 15, wherein an opening of said slide groove faces said second slide member.

* * * * *